US011993883B2

(12) United States Patent
Matsushima

(10) Patent No.: US 11,993,883 B2
(45) **Date of Patent: *May 28, 2024**

(54) SEWING MACHINE

(71) Applicant: BROTHER KOGYO KABUSHIKI KAISHA, Nagoya (JP)

(72) Inventor: Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 18/172,451

(22) Filed: Feb. 22, 2023

(65) Prior Publication Data

US 2023/0203730 A1 Jun. 29, 2023

Related U.S. Application Data

(63) Continuation of application No. 17/166,522, filed on Feb. 3, 2021, now Pat. No. 11,608,577, which is a continuation of application No. 16/460,553, filed on Jul. 2, 2019, now Pat. No. 10,934,649.

(30) Foreign Application Priority Data

Jul. 3, 2018 (JP) ..... 2018-127029

(51) Int. Cl.
*D05B 79/00* (2006.01)
*D05B 19/16* (2006.01)
*D05C 5/02* (2006.01)

(52) U.S. Cl.
CPC ..... *D05C 5/02* (2013.01); *D05B 19/16* (2013.01)

(58) Field of Classification Search
CPC ..... D05B 79/00; D05B 21/00; D05B 19/16; D05C 5/02
See application file for complete search history.

(56) References Cited

U.S. PATENT DOCUMENTS

| | | | |
|---|---|---|---|
| 5,072,680 | A | 12/1991 | Nakashima |
| 5,195,451 | A | 3/1993 | Nakashima |
| 5,323,722 | A | 6/1994 | Goto et al. |
| 6,161,491 | A | 12/2000 | Takenoya et al. |
| 7,212,880 | B2 | 5/2007 | Mizuno et al. |
| 8,738,168 | B2 | 5/2014 | Naka et al. |
| 9,302,404 | B2 | 4/2016 | Matsushima et al. |

(Continued)

FOREIGN PATENT DOCUMENTS

| | | | |
|---|---|---|---|
| JP | H05-269278 | A | 10/1993 |
| JP | 2015-173876 | A | 10/2015 |

*Primary Examiner* — Tajash D Patel
(74) *Attorney, Agent, or Firm* — Oliff PLC

(57) ABSTRACT

The sewing machine includes a projector and a controller. The controller determines a sewing area inside an embroidery hoop such that the sewing area is greater than a projection area where the projector projects a projection image. The controller determines an embroidery pattern and a position of the embroidery pattern located relative to the sewing area. The controller determines, in the sewing area, a target area corresponding to the projection area. The controller generates projection image data representing a part or a whole, which falls in the target area, of the embroidery patter relative to the sewing area, and controls the projector to project a projection image based on the projection image data after moving the embroidery hoop.

8 Claims, 10 Drawing Sheets

(56) References Cited

U.S. PATENT DOCUMENTS

| | | | | |
|---|---|---|---|---|
| 9,650,734 | B2 | 5/2017 | Elliott et al. | |
| 9,739,000 | B2 | 8/2017 | Shimizu et al. | |
| 10,934,649 | B2 | 3/2021 | Matsushima | |
| 11,608,577 | B2 * | 3/2023 | Matsushima | D05C 5/02 |
| 2015/0259841 | A1 | 9/2015 | Ihira et al. | |
| 2021/0356849 | A1 | 11/2021 | McNeeley et al. | |

* cited by examiner

SEWING MACHINE

CROSS-REFERENCE TO RELATED APPLICATION

This application is a continuation of U.S. patent application Ser. No. 17/166,522, filed Feb. 3, 2021, which is a continuation of U.S. patent application Ser. No. 16/460,553, filed Jul. 2, 2019 (now U.S. Pat. No. 10,934,649 issued Mar. 2, 2021), which claims priority from Japanese Patent Application No. 2018-127029 filed on Jul. 3, 2018, the content of which is incorporated herein by reference in its entirety.

TECHNICAL FIELD

Aspects of the disclosure relate to a sewing machine.

BACKGROUND

A known sewing machine includes a projector that projects a projection image of an embroidery pattern to be sewn, onto a workpiece held by an embroidery hoop.

SUMMARY

In the known sewing machine, a sewing area for an embroidery pattern to be sewn is set inside the embroidery hoop, and a projection image of the embroidery pattern to be sewn is projected by the projector in a projection area. When the sewing area is greater than the projection area, an image representing an embroidery pattern to be sewn located relative to the sewing area may not be projected properly.

Aspects of the disclosure provide a sewing machine configured to more reliably project an image representing an embroidery pattern relative to a sewing area set inside an embroidery hoop when the sewing area is greater than a projection area of the projector.

According to one or more aspects of the disclosure, a sewing machine includes a bed, a moving mechanism, a sewing unit, a projector, and a controller. The moving mechanism supports a removable embroidery hoop and is configured to move the embroidery hoop. The sewing unit includes a needle bar. The needle bar supports a needle. The sewing unit is configured to move the needle bar up and down relative to a workpiece held by the embroidery hoop attached to the moving mechanism such that the needle supported in the needle bar forms stitches on the workpiece. The projector is configured to project a projection image toward the bed. The controller is configured to control the moving mechanism, the sewing unit, and the projector. The controller is further configured to: determine a sewing area inside the embroidery hoop, the sewing area being greater than a projection area where the projector projects the projection image; determine an embroidery pattern to be sewn and a position of the embroidery pattern located relative to the sewing area; determine an embroidery pattern to be sewn and a position of the embroidery pattern located relative to the sewing area; control the moving mechanism to move the embroidery hoop to a position where the target area coincides with the projection area; generate projection image data representing a part or a whole, which falls in the target area, of the embroidery pattern relative to the sewing area; and after moving the embroidery hoop, control the projector to project the projection image based on the projection image data, the projection image falling in the projection area.

DETAILED DESCRIPTION

Figure 1:
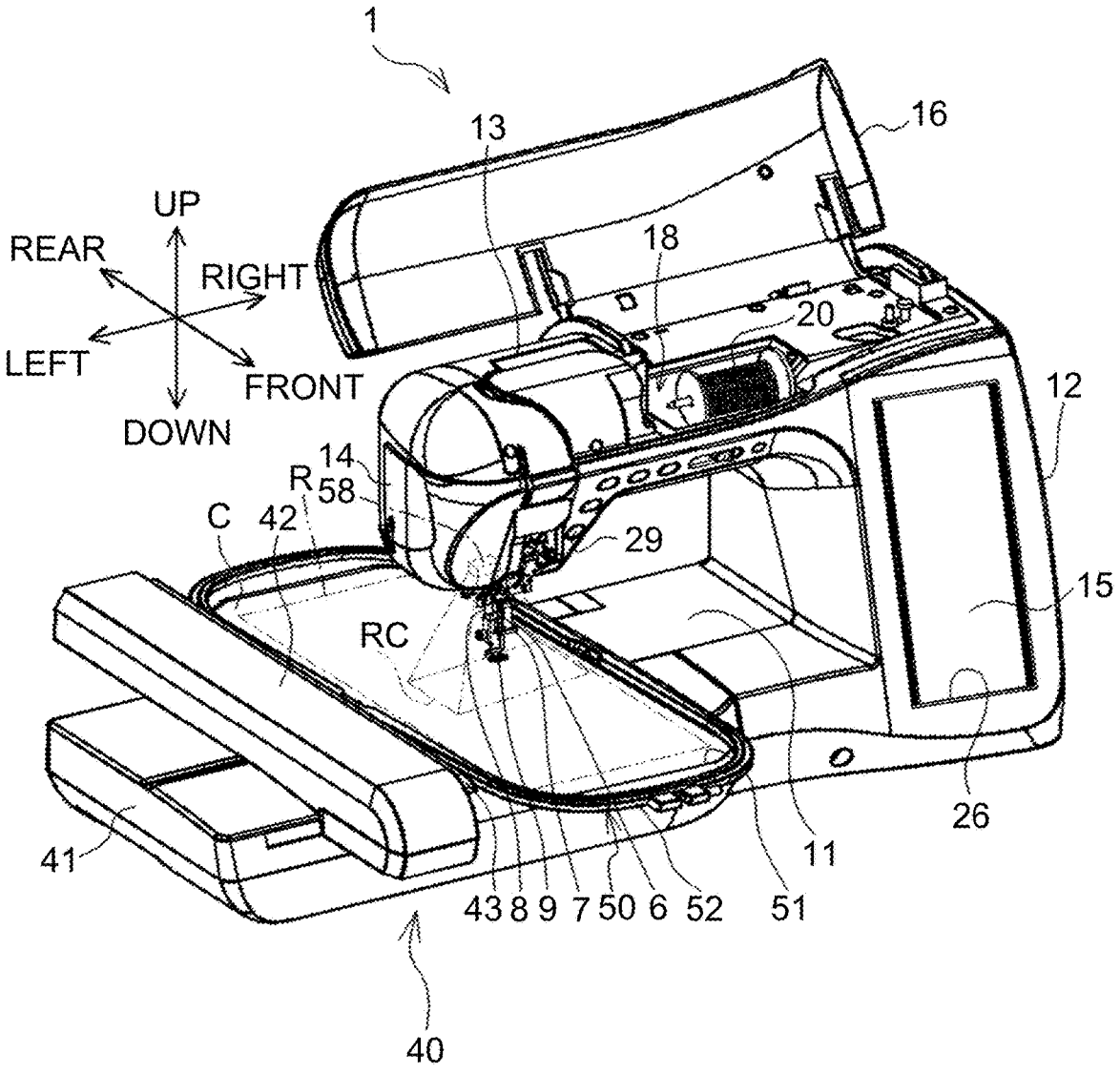
FIG. 1 is a perspective view of a sewing machine with a movement mechanism attached thereto according to one or more aspects of the disclosure.
Figure 2:
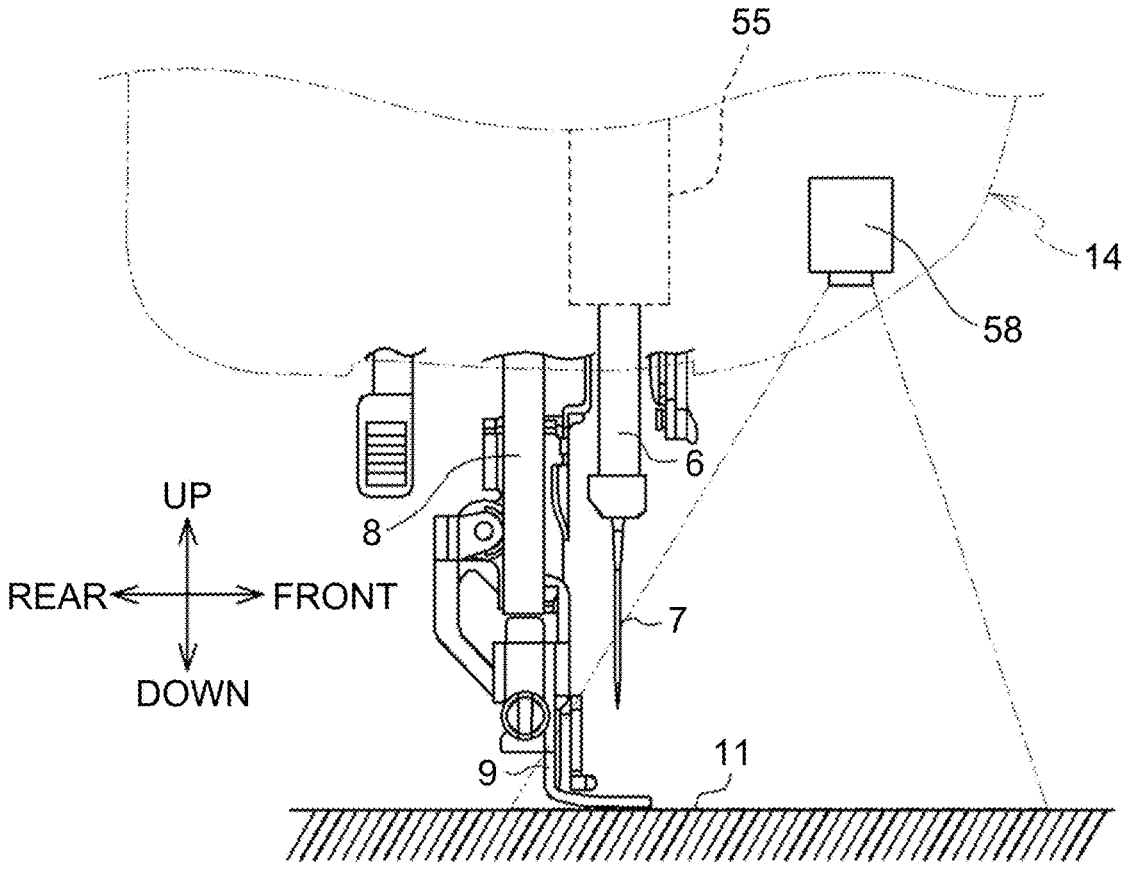
FIG. 2 is a diagram illustrating a configuration of a lower portion of a head of the sewing machine according to one or more aspects of the disclosure.
Figure 3:
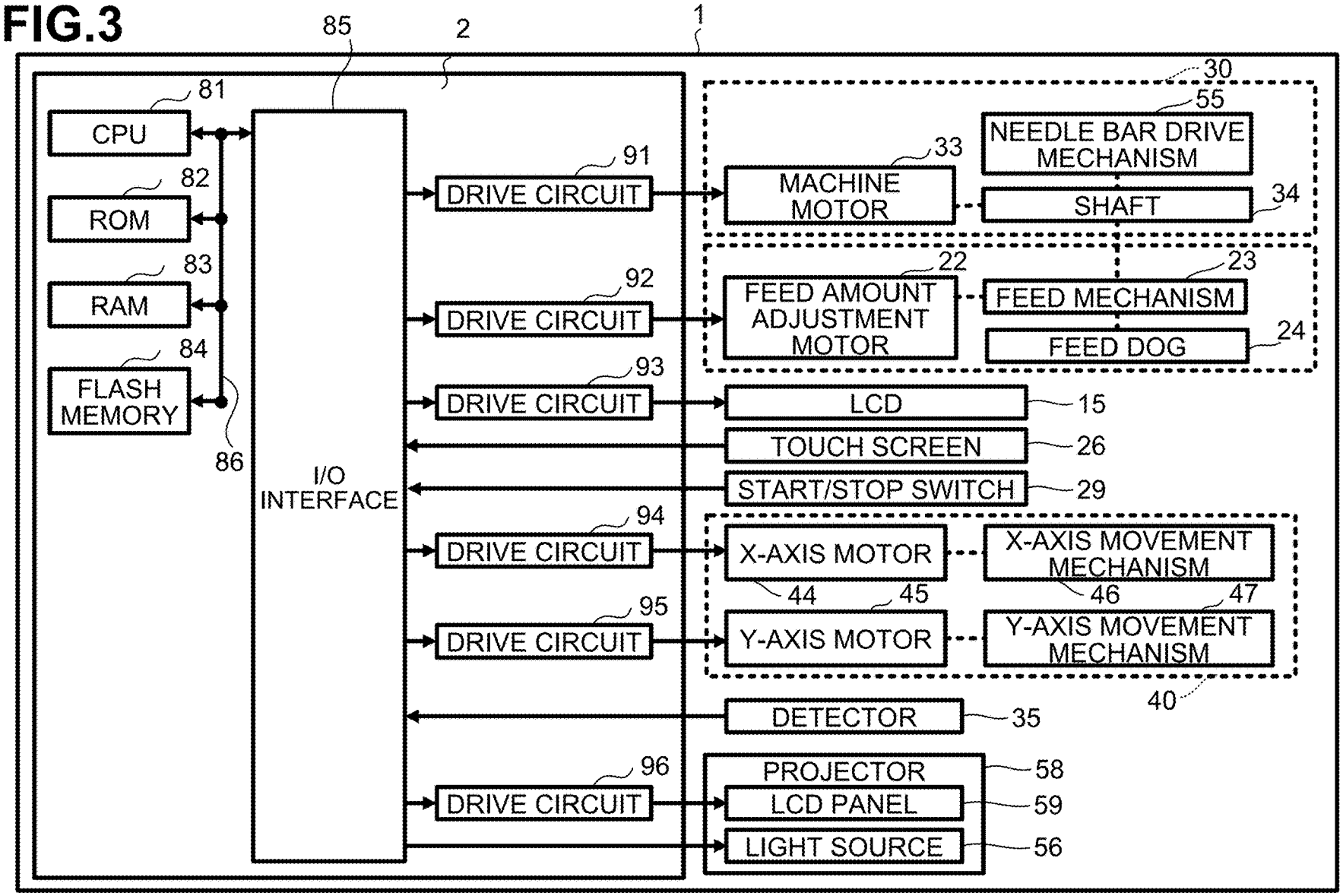
FIG. 3 is block diagram illustrating an electrical configuration of the sewing machine according to one or more aspects of the disclosure.

An embodiment is described with reference to the accompanying drawings. Referring to FIGS. 1 to 3, a configuration of a sewing machine 1 with a movement mechanism 40 is described. In the following description, directional terminology, such as "up/upper," "down/lower," "front," "rear," "left," "right" etc., as labeled in the drawings, may be used. In the page of FIG. 1, an upper side, a lower side, a lower right side, an upper left side, a lower left side, and an upper right side respectively correspond to an upper side, a lower side, a front side, a rear side, a left side, and a right side. A longitudinal direction of a bed 11 and a horizontal arm 13 corresponds to a left-right direction of the sewing machine 1. A side of the sewing machine 1 on which an upright arm 12 is located is the right side of the sewing machine 1. A direction in which the upright arm 12 is elongated is an up-down direction of the sewing machine 1.

As illustrated in FIG. 1, the sewing machine 1 includes the bed 11, the upright arm 12, the horizontal arm 13, and a head 14. The bed 11 is a base portion of the sewing machine 1, and extends in the left-right direction. The upright arm 12 extends upward from a right end portion of the bed 11. The horizontal arm 13 extends leftward from an upper end of the upright arm 12 and faces the bed 11. The head 14 is connected to a left end portion of the horizontal arm 13.

The bed 11 includes a needle plate (not illustrated) at an upper surface thereof. The needle plate has a needle hole 3 (refer to FIGS. 6 and 7) into which a needle 7 is inserted. The sewing machine 1 includes, in the bed 1, a feed dog 24 and a feed unit 23, which are indicated in FIG. 3, and a shuttle mechanism (not illustrated). The feed unit 23 drives the feed dog 24 during plain sewing, not embroidering, to feed a workpiece by a specified amount. The shuttle mechanism causes an upper thread (not illustrated) to be entwined or intertwined with a lower thread (not illustrated) underneath the needle plate.

A liquid crystal display ("LCD") 15 is disposed at a front surface of the upright arm 12. The LCD 15 is configured to display an image including various items, such as commands, illustration, settings, and messages. The LCD 15 includes a touch screen 26 on a front surface thereof. The touch screen 26 is configured to detect a position or a portion thereof pressed or touched by a user with his/her finger or a stylus (not illustrated). The sewing machine 1 includes a controller 2 (FIG. 3). The controller 2 is configured to, based on the position detected by the touch screen 26, recognize an item selected on the image. A user's operation of pressing or touching the touch screen 26 may be hereinafter referred to as a "panel operation". A user is allowed to select an embroidery pattern, as well as a command to be executed, with a panel operation. The upright arm 12 includes a machine motor 33 (FIG. 3) therein.

A cover 16 is disposed at an upper portion of the horizontal arm 13. The cover 16 is configured to pivot between an open position and a closed position. FIG. 1 illustrates the cover 16 at the open position. A spool storage 18 is located below the cover 16 at the closed position (e.g., in a space defined in the horizontal arm 13). The spool storage 18 is configured to receive a spool 20 having the upper thread wound thereon. Inside the horizontal arm 13, a shaft 34 (refer to FIG. 3) extends in the left-right direction. The shaft 34 is configured to be rotated by the machine motor 33. Various switches, including a start/stop switch 29, are located at a lower left portion of the front surface of the horizontal arm 13. The start/stop switch 29 is used to input an instruction to start or stop sewing.

As illustrated in FIGS. 2 and 3, the head 14 includes a sewing unit 30, a presser bar 8, and a projector 58. The sewing unit 30 includes a needle bar 6, and is configured to move the needle bar 6 up and down for forming stitches on a workpiece C. The needle bar 6 is located above the needle hole 3. The needle 7 is removably attached to a lower end of the needle bar 6. The sewing unit 30 further includes the shaft 34, and a needle bar drive mechanism 55 configured to drive the needle bar 6 in the up-down direction by the rotation of the shaft 34. A presser foot 9 is removably attached to a lower end of the presser bar 8. The presser foot 9 is movable between a lower position and an upper position together with the presser bar 8. At the lower position, the presser foot 9 presses the workpiece C down. At the upper position, the presser foot 9 is spaced upward from the workpiece C. The presser foot 9 is configured to intermittently press the workpiece C down in association with the up-down movement of the needle bar 6.

The projector 58 is configured to project a color image onto the bed 11. The projector 58 includes a cylindrical casing, a liquid crystal panel (LCP) 59 (FIG. 3), a light source 56 (FIG. 3), and an image forming lens (not illustrated), which are disposed in the casing. The casing of the projector 58 is fixed to a machine casing in the head 14. The light source 56 may be a LED. The LCP 59 is configured to modulate the light from the light source 56 and form image beams for a projection image to be projected based on image data representing the projection image. The image forming lens uses the image beams formed by the LCP 59 to form an image on a workpiece C held by an embroidery hoop 50 attached to a holder 43. An area in which a projection image is projected refers to a projection area RC. The projection area RC includes a position below the needle bar 6, which corresponds to the needle hole 3. The projection area RC is uniquely defined by a factor, such as, the position of the projector 58, the orientation of the projector 58, and the distance from the imaging forming lens to the upper surface of a workpiece C. As the projector 58 projects a projection image, from diagonally above, onto the workpiece C (toward the bed 11), the projection image undergoes image distortion correction. The flash memory 84 stores the size of the projection area RC of the projector 58 (e.g., a number of dots on the long and short sides of a rectangular area).

The movement mechanism 40 is detachably attached to the bed 11 of the sewing machine 1. The movement mechanism 40 includes a holder 43 for holding a removable embroidery hoop 50 that holds a workpiece C. The movement mechanism 40 is configured to move the holder 43 relative to the needle bar 6. The movement mechanism 40 is configured to support a selected one of attachable embroidery hoops including the embroidery hoop 50. The embroidery hoop 50 includes a first hoop member 51 and a second hoop member 52 and can hold a workpiece C in sheet form (e.g., a work cloth) by sandwiching it between the first and second hoop members 51, 52. The movement mechanism 40 includes a base 41 and a carriage 42. The carriage 42 includes the holder 43, a Y-axis movement mechanism 47, and a Y-axis motor 45. The holder 43 is disposed on a right side surface of the carriage 42. The holder 42 of the carriage 2 holds the removable embroidery hoop 50. The Y-axis movement mechanism 47 moves the holder 43 in the front-rear direction (Y-axis direction). The Y-axis motor 45 drives the Y-axis movement mechanism 47. The base 41 includes an X-axis movement mechanism 46 and an X-axis motor 44, which are indicated in FIG. 3. The X-axis movement mechanism 46 moves the carriage 42 in the left-right direction (X-axis direction). The X-axis motor 44 drives the X-axis movement mechanism 46. During embroidering using the embroidery hoop 50, the movement mechanism 40 is configured to move the embroidery hoop 50 attached to the holder 43 of the carriage 42 to a position in an inherent x and y coordinate system (embroidery coordinate system).

Referring to FIG. 3, an electrical configuration of the sewing machine 1 is described. The sewing machine 1 includes a CPU 81, a ROM 82, a RAM 83, the flash memory 84, an input/output ("I/O") interface 85, and drive circuits 90-96. The CPU 81 is connected to the ROM 82, the RAM 83, the flash memory 84, and the I/O interface 85, via a bus 86.

The CPU 81 performs overall control of the sewing machine 1. The CPU 81 performs various calculations and processing relating to sewing, in accordance with programs stored in the ROM 82. The ROM 82 includes a plurality of storage areas (not illustrated), including a program storage area. The program storage area stores therein various programs for operating the sewing machine 1 (e.g., programs for executing a main process, which will be described in detail below).

The RAM 83 includes a storage area in which results of calculations performed by the CPU 81 is stored. The flash memory 84 stores therein various parameters to be used for performing the various processing by the sewing machine 1. The flash memory 84 stores therein pieces of pattern data of embroidery patterns that the sewing machine 1 can sew. The pattern data includes color data and coordinate data. The color data indicates a color of thread to be used during sewing an embroidery pattern. The coordinate data is associated with the color data, and indicates the coordinates, in the embroidery coordinate system, of stitch positions (needle drop positions) included in the embroidery pattern. The coordinate data includes data representing a series of the coordinates of each needle drop position. The flash memory 84 stores data on correspondences between types of embroidery hoops attachable to the holder 43 and their respective sewing areas. The sewing areas, which are determined inside of the embroidery hoops attachable to the holder 43 of the sewing machine 1, refers to areas where sewing or embroidering is possible. The flash memory 84 further stores variables each associating the coordinates in the embroidery coordinate system with the coordinates in a coordinate system for a projection image of the projector 58. This may allow the sewing machine 1 to determine coordinates in the projected coordinate system based on pattern data. The I/O interface 85 is connected to the drive circuits 91-96, the touch screen 26, the start/stop switch 29, the light source 56 of the projector 58, and a detector 35. The detector 35 is configured to detect that an embroidery hoop has been attached to the movement mechanism 40 and send a signal corresponding to the detected embroidery hoop to the I/O interface 85. The detector 35 detects a type of embroidery hoop in accordance with a combination of turning on and off of mechanical switches. The light source 56 is turned on based on a control signal from the CPU 81 and a projection image displayed on the LCP 59 is projected onto the workpiece, which is to be moved on the bed 11.

The drive circuit 91 is connected to the machine motor 33. The drive circuit 91 drives the machine motor 33 based on a control signal from the CPU 81. Driving the machine motor 33 causes the needle bar drive mechanism 55 to be driven via the shaft 34, thereby moving the needle bar 6 up and down. The drive circuit 92 is connected to a feed amount adjustment motor 22. The drive circuit 93 drives the LCD 15 to display an image on the LCD 15 based on a control signal from the CPU 81. The drive circuit 94 is connected to the X-axis motor 44. The drive circuit 95 is connected to the Y-axis motor 45. The drive circuits 94, 95 drive the X-axis motor 44 and the Y-axis motor 45, respectively, based on a control signal from the CPU 81. In response to the driven X-axis motor 44 and Y-axis motor 45, the embroidery hoop 50 attached to the movement mechanism 40 moves in the left-right direction (X-axis direction) and the front-rear direction (Y-axis direction). The drive circuit 96 drives the LCP 59 of the projector 58 to display a projection image on the LCP 59 based on a control signal from the CPU 81.

Operation of the sewing machine 1 is described. During embroidering using the embroidery hoop 50, the movement mechanism 40 moves the embroidery hoop 50 in the X-axis direction and the Y-axis direction, and the needle bar drive mechanism 55 and the shuttle mechanism (not illustrated) are driven accordingly. Thus, the needle 7 attached to the needle bar 6 is operated to sew an embroidery pattern on a workpiece C held by the embroidery hoop 50.

Referring to FIGS. 4-10, the main process of the sewing machine 1 is described. The main process may be executed, based on an instruction from a user, to cause the projector 58 to project a sewing image of an embroidery pattern to be sewn. The embroidery pattern may be selected by the user with the panel operation from embroidery patterns stored in the flash memory 84. The main process may be started based on an instruction for the start of the main process from a user with the panel operation after the user selects an embroidery pattern. On determining that the start of the main process has been instructed, the controller 2 reads out a program for executing the main process stored in the program storage area of the ROM 82, into the RAM 83. The controller 2 executes the following steps based on the instructions included in the program read into the RAM 83. The flash memory 84 stores therein parameters required for performing the main process. Various data obtained during the main process are stored in the RAM 83 at appropriate times. Example 1 describes a case where the user selects an embroidery pattern 60 illustrated in FIG. 5A and then inputs an instruction to start the main process. The embroidery pattern 60 is a bouquet to be sewn with multiple colors of thread. The embroidery pattern 60 is sized to fit in the sewing area R, but is greater than the projection area RC of the projector 58. Example 2 describes a case where the user selects an embroidery pattern 68 illustrated in FIG. 5A and then inputs an instruction to start the main process. The embroidery pattern 68 is a star in a circle to be sewn with a single color of thread. The embroidery pattern 68 is sized to fit in the sewing area R. For simplicity of description purpose, the following collectively describes the main process regarding example 1 and the main process regarding example 2, which are executed at different times. In the following description, image data to be processed by the controller 2 may be simply referred to as an image or a projection image. The embroidery hoop 50 is moved with the presser foot 9 at its upper position. An embroidery pattern is stitched with the presser foot 9 at its lower position.

Figure 4:
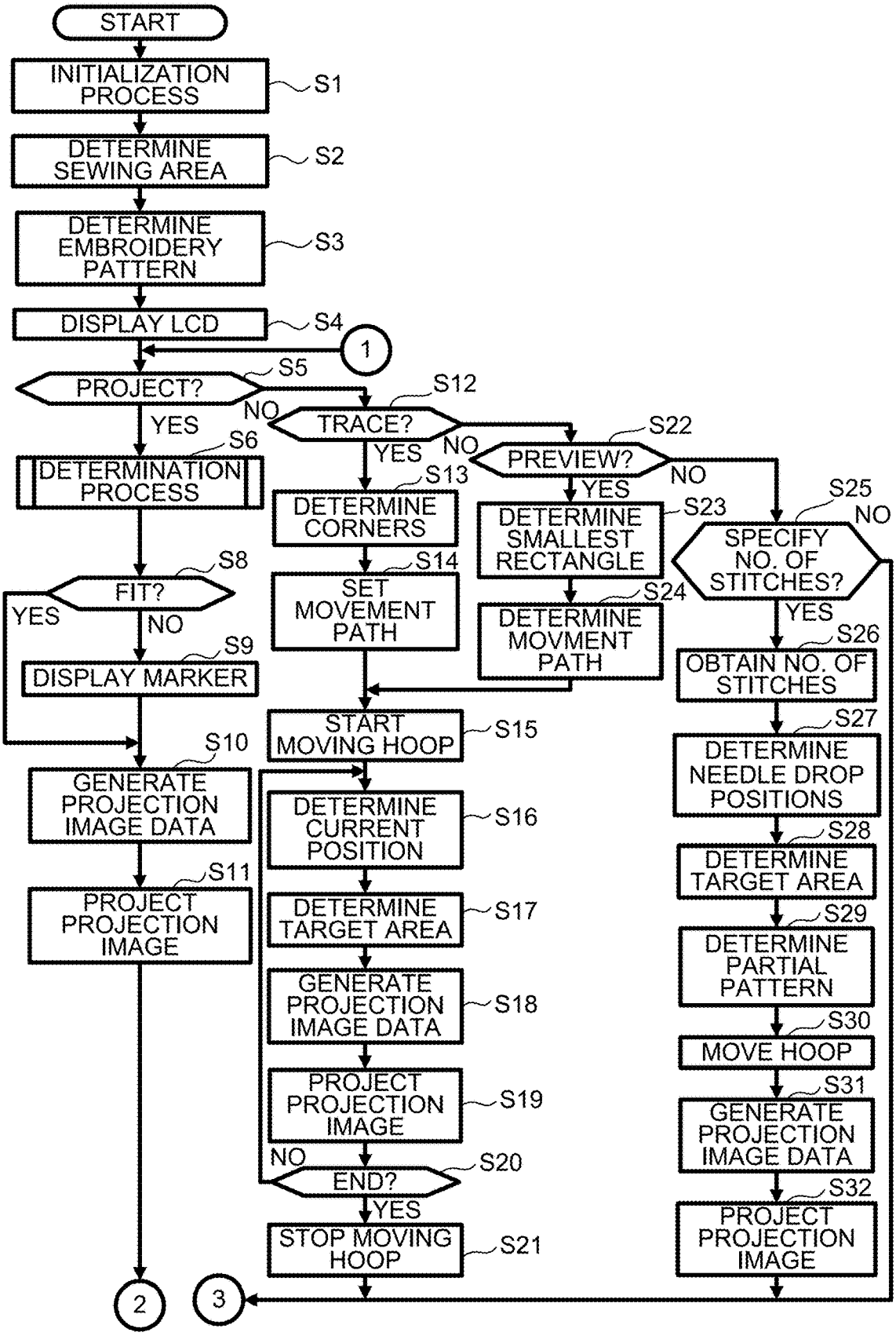
FIG. 4 is a flowchart of a main process according to one or more aspects of the disclosure.

As illustrated in FIG. 4, the controller 2 executes an initialization process (S1). In the initialization process, the controller 2 resets each setting to an initialized state. The controller 2 determines a sewing area R, which is to be set inside the embroidery hoop 50 attached to the holder 43 and is greater than a projection area RC for a projection image to be projected (S2). The controller 2 retrieves the size of the sewing area R based on a correspondence between, for example, a type of embroidery hoop 50, which is determined by an output value of the detector 35, and a type of embroidery hoop 50 and the size of the sewing area, which are stored in the flash memory 84. A method to retrieve the size of the sewing area R may be changed appropriately. The size of the sewing area R may be retrieved with a value inputted by the user. The sewing area R is shaped like a rectangle extending in the X-axis direction and the Y-axis direction in the embroidery coordinate system and measured by the dimensions on the X axis and the Y axis in the embroidery coordinate system.

The controller 2 determines a selected embroidery pattern and a position of the embroidery pattern relative to the sewing area R (S3). The controller 2 determines the embroidery pattern 60 in example 1 and the embroidery pattern 68 in example 2. The position of the embroidery pattern relative to the sewing area R may be specified by the user or determined in advance. To determine the position of the embroidery pattern relative to the sewing area R, the controller 2 may position the center of the embroidery pattern on the center of the sewing area R. In example 1, the embroidery pattern 60 has a center 66, which is located in the smallest rectangle 61 enclosing the embroidery pattern 60. The smallest rectangle 61 has points 62-65 as vertexes and short and long sides extending in the X-axis direction and Y-axis direction.

The controller 2 controls the LCD 15 to display an image of the embroidery pattern, determined at S3, in the sewing area R (S4). In example 1 illustrated in FIG. 5A, the controller 2 displays a screen 70 on the LCD 15. The screen 70 includes a pattern display section 71, virtual keys 72-76, and a virtual keypad 77. The pattern display section 71 has a display area corresponding in shape to the sewing area R, and displays a sewing image of the embroidery pattern 60 relative to the sewing area R. More specifically, the pattern display section 71 on the screen 70 displays the sewing image of the embroidery pattern 60 relative to the sewing area R with the center 66 of the embroidery pattern 60 positioned on the center of the sewing area R. The virtual key 72 is used to enable the projector 58 to project the sewing image of the embroidery pattern 60. The virtual key 73 is used to trace a contour of the sewing area R such that its points 62, 63, 64, and 65 in this order meet and coincide with the position of the needle bar 6. The virtual key 74 is used to preview the sewing image of the embroidery pattern 60 to be projected by the projector 58, by moving the embroidery hoop 50. The virtual key 75 is used to enable the projector 58 to project the sewing image of the embroidery pattern 60 where a specified number of stitches are made. The virtual key 76 is used to start sewing. The virtual keypad 77 is used to change the position of the embroidery pattern 60 relative to the sewing area R. The screen 70 may include other virtual keys to edit the embroidery pattern 60, such as resizing, rotation, and color change. Although not illustrated in detail, the screen for example 2 is similar to the screen 70 for example 1, except for the pattern display section 71. In example 2 illustrated in FIG. 5B, the pattern display section 71 displays a sewing image of the embroidery pattern 68 relative to the sewing area R.

If the controller 2 detects that the virtual key 72 has been selected (S5: YES), the controller 2 executes a determination process (S6). The determination process is for setting a target area TR in a virtual sewing area R to determine the position of the embroidery hoop 50 relative to the needle bar 6 in response to the size of the embroidery pattern relative to the size of the projection area RC. The target area TR is provided inside the embroidery hoop 50, where the projector 58 projects a projection image. In short, the target area TR corresponds to the projection area RC of the projector 58. The target area TR is identical with the projection area RC. The sewing machine 1 sets the projection area RC of the projector 58 fixedly relative to the needle bar 6. The sewing machine 1 thus can change, in the sewing area R, the position of the projection area RC for the projection image to be projected by the projector 58 by moving the embroidery hoop 50 relative to the needle bar 6. The relative position between the projection area RC and the sewing area R can be changed by moving the embroidery hoop 50 relative to the needle bar 6.

Figure 6:
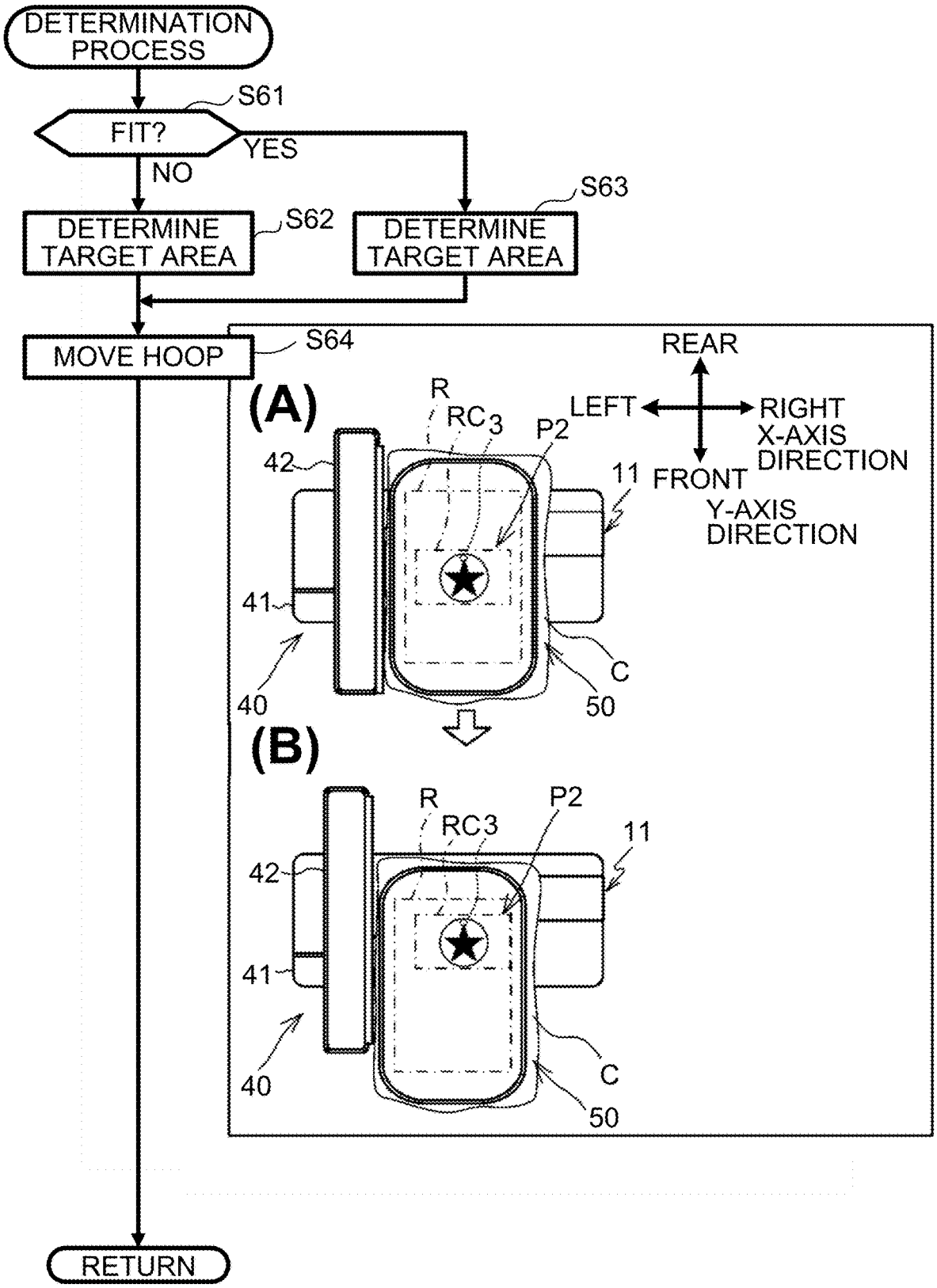
FIG. 6 is a flowchart of a determination process to be executed in the main process illustrated in FIGS. 4 and 8 according to one or more aspects of the disclosure.

In the determination process illustrated in FIG. 6, the controller 2 determines whether the embroidery pattern is fit in the projection area RC (S61). The controller 2 determines whether the embroidery pattern is fit in the projection area RC based on, for example, a comparison in size between the smallest rectangle enclosing the embroidery pattern and the projection area RC. In example 1, the embroidery pattern 60 is not fit in the projection area RC (S61: NO). In this case, the controller 2 sets the target area TR in a specified position (S62). The specified position in the determination process at S6 may be set as appropriate. In this embodiment, the specified position is where the center of the target area TR coincides with the center of the sewing area R. In example 2, the embroidery pattern 68 is fit in the projection area RC (S61: NO). In this case, the controller 2 determines the target area TR such that the embroidery pattern 68 is entirely fit in the target area TR (S63). The controller 2 may determine the target area TR such that a reference point (e.g., a center) of the target area TR coincides with a reference point (e.g., a center) of the embroidery pattern 68 located in the sewing area R. Subsequent to S62 or S63, the controller 2 controls the movement mechanism 40 to move the embroidery hoop 50 to a position where the target area RC set at S62 or S63 coincides with the projection area RC (or a specified position where the target area TR coincides with the position of the needle bar 6) (S64). The controller 2 ends the determination process and returns to the main process.

Subsequent to S6 in FIG. 4, the controller 2 determines whether the embroidery pattern selected at S2 is fit in the projection area RC, as with S61 (S8). In example 1, the controller 2 determines that the embroidery pattern 60 is not fit in the projection area RC (S8: NO) and controls the LCD 15 to display a marker Z representing the position of the target area TR relative to the sewing area R on the embroidery pattern located relative to the sewing area R (S9).

Figure 5A:
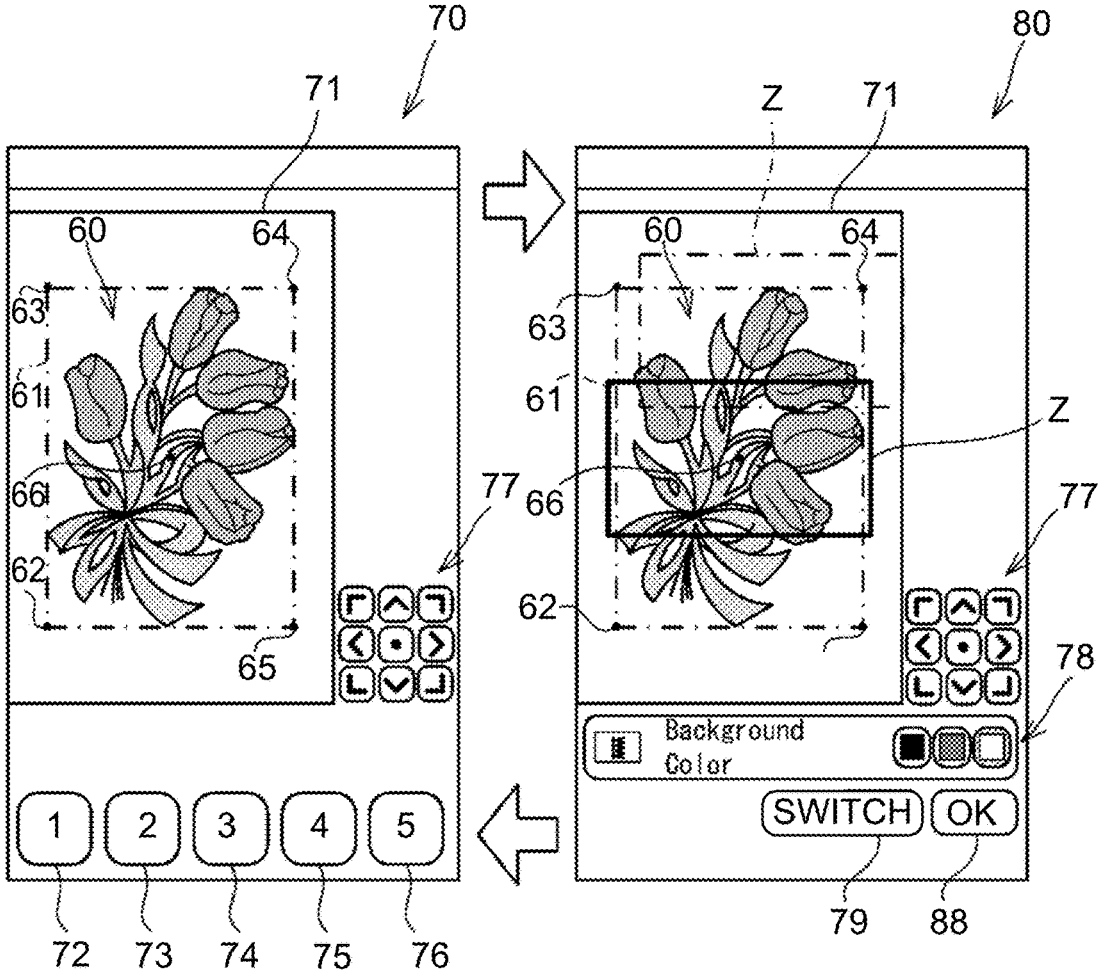
FIG. 5A illustrates transition of a screen to be displayed during the main process regarding example 1 according to one or more aspects of the disclosure.

As illustrated in FIG. 5A, for example, the controller 2 controls the LCD 15 to replace the screen 70 with a screen 80 and to display the marker Z representing the position of the target area TR relative to the sewing area R on the screen 80. The screen 80 includes a pattern display section 71, virtual keypads 77, 78, and virtual keys 79, 88. The pattern display section 71 and the virtual keypad 77 on the screen 80 are similar to those on the screen 70. The pattern display section 71 on the screen 80 displays the marker Z on the image of the embroidery pattern 60. The marker Z is a red rectangle. The marker Z corresponds in size and shape to the target area TR, and the position of the marker Z on the pattern display section 71 corresponds to the position of the target area TR relative to the sewing area R. The virtual keypad 78 is used to change a background color for a projection image. In the sewing machine 1 according to the illustrative embodiment, the background color for a projection image is selectable between black, gray, and white. For the screen 80 in FIG. 5A, white is selected as the background color for a projection image. The virtual key 79 is used to switch methods to change the position of the target area TR relative to the embroidery pattern 60 in the sewing area R. The sewing machine 1 provides two methods to change the position of the target area TR relative to an embroidery pattern. A first method is to change the position of the marker Z on the LCD 15 with the panel operation while the position of the embroidery pattern 60 in the sewing area R remains fixed on the LCD 15. A second method is to change the position of the embroidery pattern 60 on the LCD 15 with the panel operation while the position of the marker Z remains fixed on the LCD 15. The virtual key 88 is used to end projection processing by the projector 58 to return to the screen 70.

At S8, in example 2, the controller 2 determines that the embroidery pattern 68 is fit in the projection area RC (S8: YES), and controls the LCD 15 to display a screen, not illustrated, similar to the screen 80. The controller 2, however, does not display the marker Z in the pattern display section 71 as illustrated in the right figure of FIG. 5B. When the controller determines that the embroidery pattern is fit in the projection area RC (S8: YES) or subsequent to S9, the controller 2 generates projection image data representing a part or a whole, which falls in the target area TR, of the embroidery pattern relative to the sewing area R (S10). In example 1, the embroidery pattern 60 is greater than the projection area RC. The controller 2 generates a projection image P1 representing a part, which falls in the target area TR, of the embroidery pattern 60. The part of the embroidery pattern 60 in included in the projection image P1 corresponds to a part enclosed in the marker Z in FIG. 5A. In example 2, the embroidery pattern 68 is smaller than the projection area RC, and the target area TR is set at S63 such that the whole of the embroidery pattern 68 is fit in the target area TR. The controller 2 generates a projection image P2 representing the whole of the embroidery pattern 68.

After moving the embroidery hoop 50 at S64, the controller 2 controls the LCP 59 to cause the projector 58 to project the projection image generated at S10 (S11). In example 1 illustrated in FIG. 7A, the projection image P1 is projected onto a workpiece C. In example 2 illustrated in illustration (A) in FIG. 6, the projection image P2 is projected onto a workpiece C. At S64, the controller 2 causes the projector 58 to project a projection image based on the projection image data generated at S10 when or after moving the embroidery hoop 50. The controller 2 may move the embroidery hoop 50 to a position specified at S62 or S63 after projector 58 projects the projection image based on the projection image data generated at S10.

The controller 2 determines whether it has received an instruction to designate the position of the target area TR in the sewing area R (S35). The controller 2 determines that it has received the instruction to designate the position of the target area TR in the sewing area R, in response to that the position of the target area TR has been changed relative to the embroidery pattern in the pattern display section 71 on the screen 80. If the controller 2 has received an instruction to change the position of the marker Z relative to the embroidery pattern fixedly displayed on the LCD 15 (S35: YES) or an instruction to change the position of the embroidery pattern relative to the marker Z fixedly displayed on the LCD 15 (S35: YES), the controller 2 determines whether the target area TR is fit in the sewing area R after the relative position between the marker Z and the embroidery pattern is changed based on the instruction received at S35 (S36). If the controller 2 determines that the target area TR is not fit in the sewing area R (S36: NO), the controller 2 sets the target area TR in the sewing area R. In this embodiment, if the controller 2 determines that the target area TR is not fit in the sewing area R, the controller 2 performs S42 without changing the relative position between the embroidery pattern and the target area TR based on the instruction received at S35. If the controller 2 determines that the target area TR is not fit in the sewing area R (S36: NO), the controller 2 may change the relative position between the embroidery pattern and the target area TR such that the target area TR is located in the sewing area R, based on the instruction at S35.

Figure 7A:
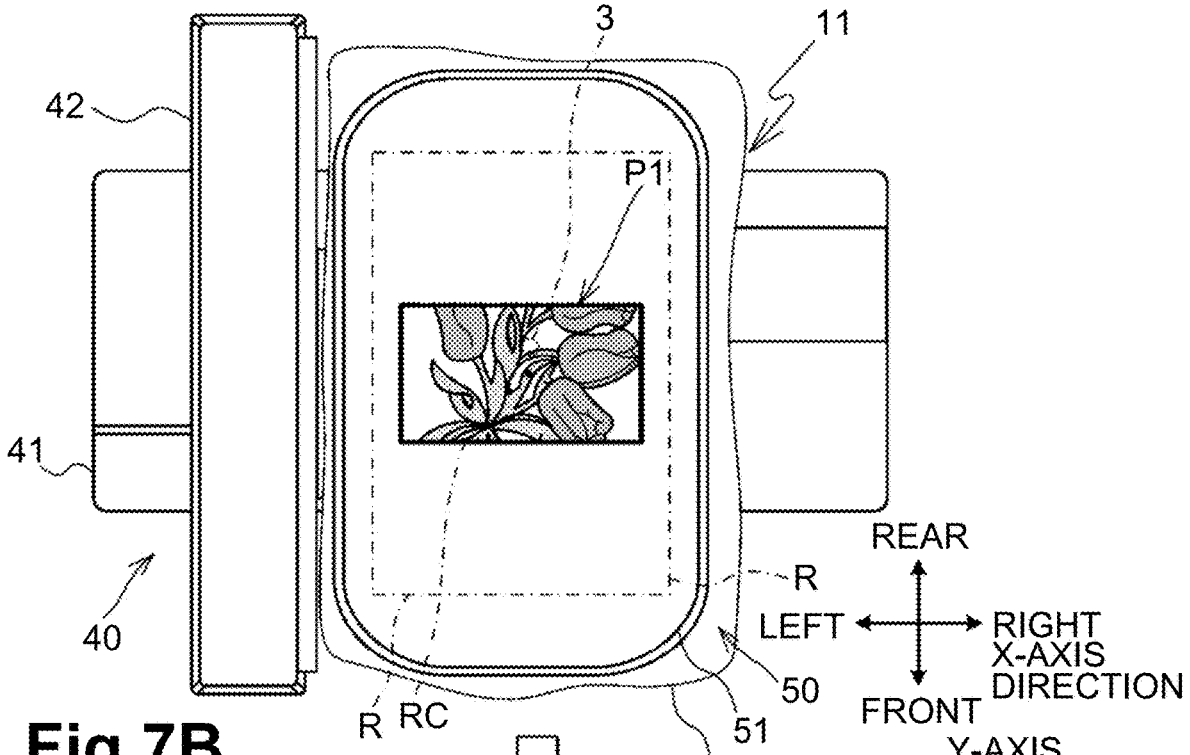
FIGS. 7A and 7B illustrate transition of a projection image to be projected by the projector relative to the embroidery hoop according to one or more aspects of the disclosure.
Figure 7B:
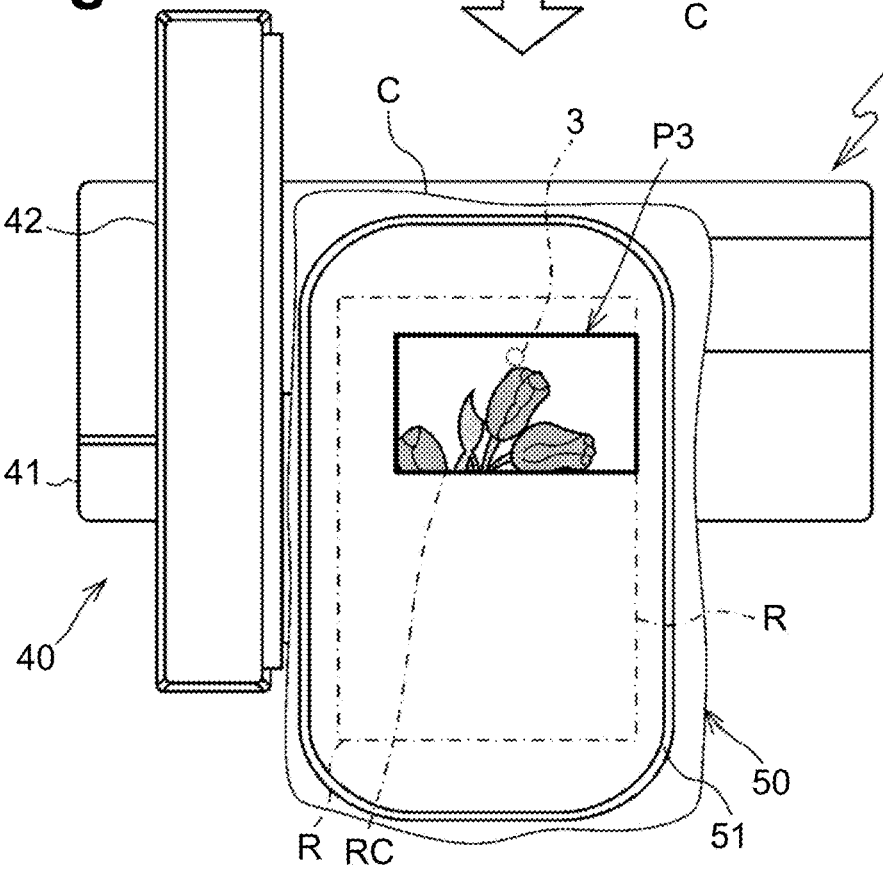
Figure 8:
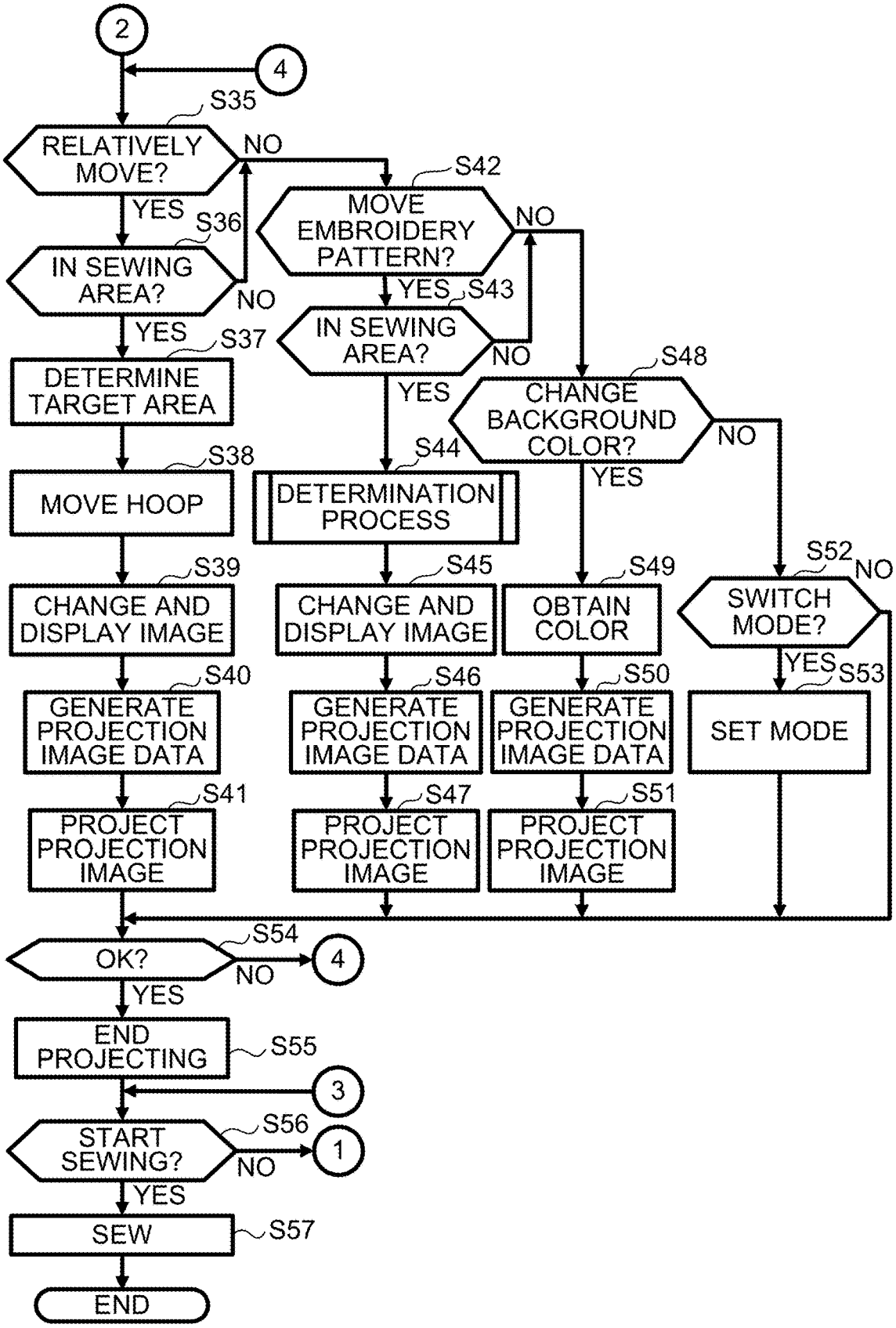
FIG. 8 is a flowchart of the main process according to one or more aspects of the disclosure.

In example 1 illustrated in FIG. 5A, if the controller 2 detects a panel operation for moving the marker Z indicated by a solid line on the screen 80 to a position indicated by a phantom line (S35: YES), the controller 2 determines that the target area TR is fit in the sewing area R (S36: YES), and determines the target area TR based on the instruction at S35 (S37). The controller 2 determines the target area TR in the sewing area R based on the position of the marker Z in the pattern display section 71. The controller 2 controls the movement mechanism 40 to move the embroidery hoop 50 to a position where the target area RC set at S37 coincides with the projection area RC (S38). The controller 2 generates an image to change the position of the marker Z to be displayed on the LCD 15, and controls the LCD 15 to display the generated image (S39). The controller 2 generates a projection image P3 representing a part, which falls in the target area TR determined at S37, of the embroidery pattern 60 (S40). As illustrated in FIG. 7B, after moving the embroidery hoop 50 at S38, the controller 2 controls the LCP 59 to cause the projector 58 to project the projection image P3 generated at S40 (S41). The projection image P3 represents a part of the embroidery pattern 60 enclosed by the marker Z, which is indicated by a phantom line in FIG. 5A. As illustrated in FIGS. 7A and 7B, before and after steps S35 to S41 are executed, the position of the projection image remains unchanged relative to the bed 11 (or the needle hole 3), but the position of the embroidery hoop 50 and a part of the embroidery pattern 60 to be displayed as the projection image are changed.

The controller 2 determines whether the virtual key 88 has been selected on the screen 80 (S54). If the controller 2 does not detect that the virtual key 88 has been selected (S54: NO), it returns to S35. If the controller 2 detects that the virtual key 88 has been selected (S54: YES), the controller 2 controls the projector 58 to end projecting of the projection image (S55), controls the LCD 15 to display the screen 70 on the LCD 15, and then executes step S56.

While the screen 80 is displayed, if the controller 2 detects that a key on the virtual keypad 77 on the screen 80 has been selected (S35: NO, S42: YES), the controller 2 moves the embroidery pattern in a direction indicated on the key selected at S42, and then determines whether the moved embroidery pattern is fit in the sewing area R (S43). If the controller 2 determines that the moved embroidery pattern is not fit in the sewing area R (S43: NO), the controller 2 sets the embroidery pattern in the sewing area R. In this embodiment, if the controller 2 determines that the moved embroidery pattern is not fit in the sewing area R (S43: NO), the controller 2 executes step S48 without changing the relative position between the embroidery pattern and the target area TR based on the detection at S42. If the controller 2 determines that the moved embroidery pattern is not fit in the sewing area R (S43: NO), the controller 2 may change the relative position between the embroidery pattern and the sewing area R such that the embroidery pattern is located in the sewing area R, based on the detection at S43.

Figure 5B:
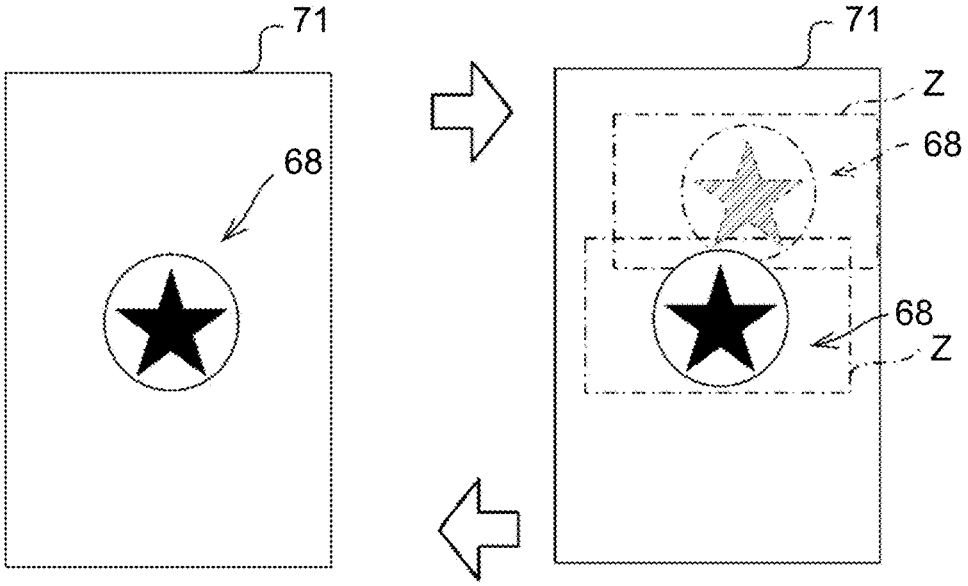
FIG. 5B illustrates transition of a screen to be displayed during the main process regarding example 2 according to one or more aspects of the disclosure.

In example 2 illustrated in FIG. 5B, if the controller 2 detects that a key on the virtual keypad 77 on the screen 80 has been selected and detects an instruction to move the embroidery pattern 68 from its initial position indicated by a solid line to a position indicated by a phantom line (S42: YES), the controller 2 determines that the moved embroidery pattern is fit in the sewing area R (S43: YES), and executes the determination process for determining the position of the target area TR based on the instruction at S42 (S44). In the determination process illustrated in FIG. 6, which is executed at S44, the controller 2 determines that the embroidery pattern 68 is fit in the projection area RC (S61: YES), and determines the target area TR relative to the sewing area R such that the whole of the embroidery pattern 68 is fit in the target area TR (S63). As the position of the embroidery pattern 68 is moved in the sewing area R based on the instruction at S42, the position of the target area TR is changed in response to the movement of the embroidery pattern 68. The controller 2 controls the movement mechanism 40, based on the target area TR determined at S63, to move the embroidery hoop 50 from its initial position illustrated in illustration (A) in FIG. 6 to a position illustrated in illustration (B) in FIG. 6 (S64). The controller 2 ends the determination process, generates an image to change the position of the embroidery pattern 68 to be displayed on pattern selection section 71 of the LCD 15, and controls the LCD 15 to display the generated image (S45). The controller 2 generates projection image data representing the embroidery pattern 68 in the target area TR determined at S63 (S46), moves the embroidery hoop 50 at S64, and controls the LCP 59 to cause the projector 58 to project the projection image generated at S40 (S47). As illustrated in illustrations (A) and (B) in FIG. 6, before and after steps S42 to S47 are executed, the position of the projection image P2 and the embroidery pattern 60 represented by the projection image P2 remain unchanged relative to the bed 11 (or the needle hole 3), but the position of the embroidery hoop 50 is changed relative to the bed 11 (or the needle hole 3).

In example 1 illustrated in FIG. 5A, at S61 where the controller 2 detects that a virtual key on the virtual keypad of the screen 80 has been selected, the controller 2 determines that the embroidery pattern 60 is not fit in the projection area RC (S61: NO), and sets the target area TR to a specified position (S62). At S62 executed at S44, for example, the controller 2 does not change the position of the current target area TR. In this case, at S64, the controller 2 ends the determination process without moving the embroidery hoop 50.

Figure 9:
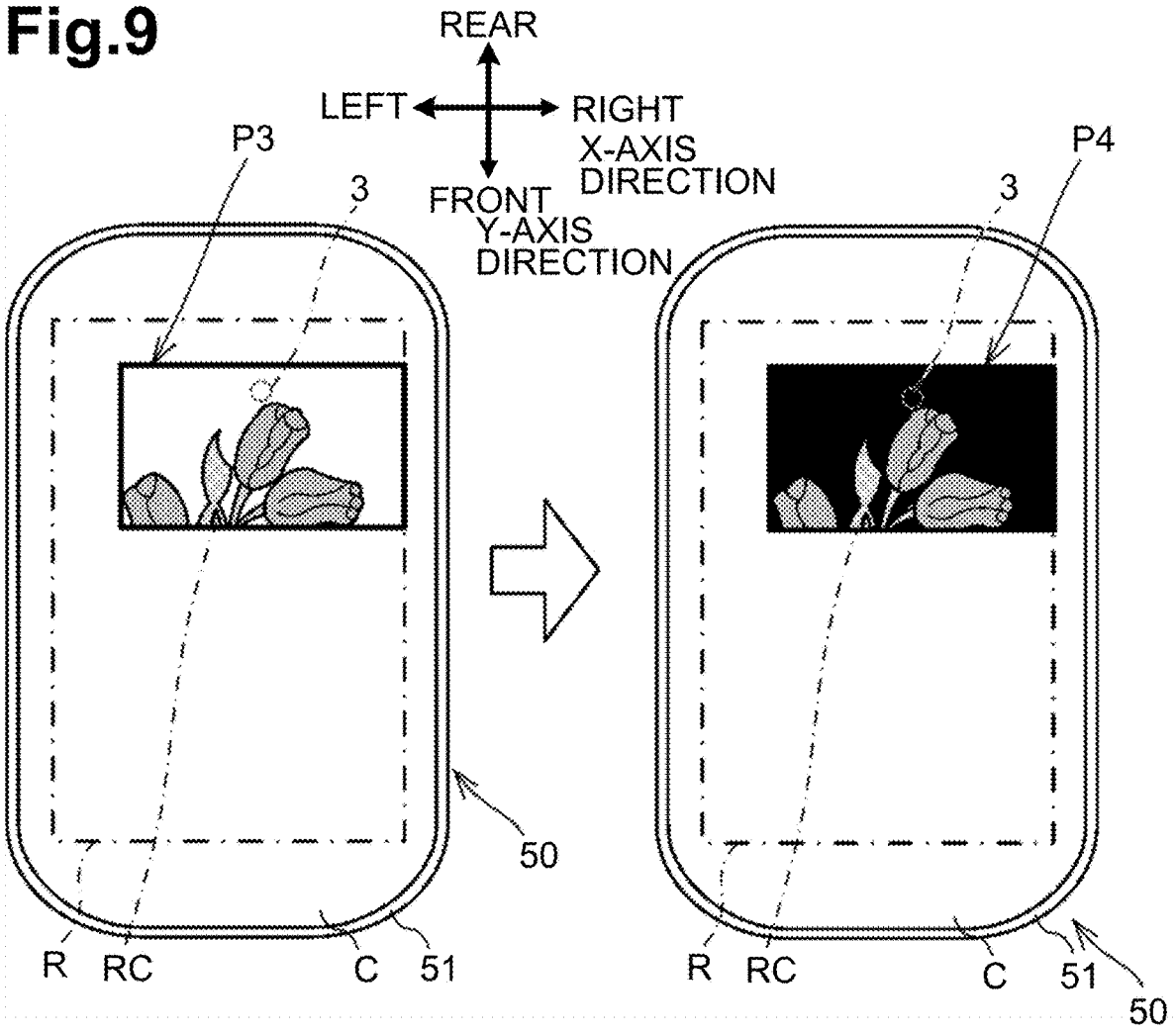
FIG. 9 illustrates transition of a projection image to be displayed during the main process regarding example 1 according to one or more aspects of the disclosure.

In example 1 illustrated in FIG. 5A, if the controller 2 detects that a virtual key on the virtual keypad 78 of the screen 80 has been selected and receives an instruction to change the background color of the projection image from white to black (S35: NO, S42: NO, S48: YES), the controller 2 receives an instruction to specify the background color of the projection image (S49). The controller 2 generates, using the background color specified at S49, a projection image P4 representing the embroidery pattern 68 in the target area TR (S50), and controls the LCP 59 to project the projection image P4 generated at S50 (S51). As illustrated in FIG. 9, through step S51, the projection image P3 on white background is changed to the projection image P4 on black background.

If the controller 2 detects that the virtual key 79 has been selected on the screen 80 (S35: NO, S42: NO, S48: NO, S52: YES), the controller 2 causes a switch from a currently set method to input a change instruction to another method (S53) When the first method is set, the controller 2 executes a process to limit the change of the position, on the LCD 15, of the embroidery pattern 60 in the sewing area R and allow the change of the position of the marker Z on the LCD 15. When the second method is set, the controller 2 executes a process to limit the change of the position of the marker Z on the LCD 15 and allow the change the position of the embroidery pattern 60 on the LCD 15. If the controller 2 does not detect that the virtual key 79 has been selected (S52: NO), and subsequent to S47, S51, or S53, the controller 2 executes S54.

Figure 10A:
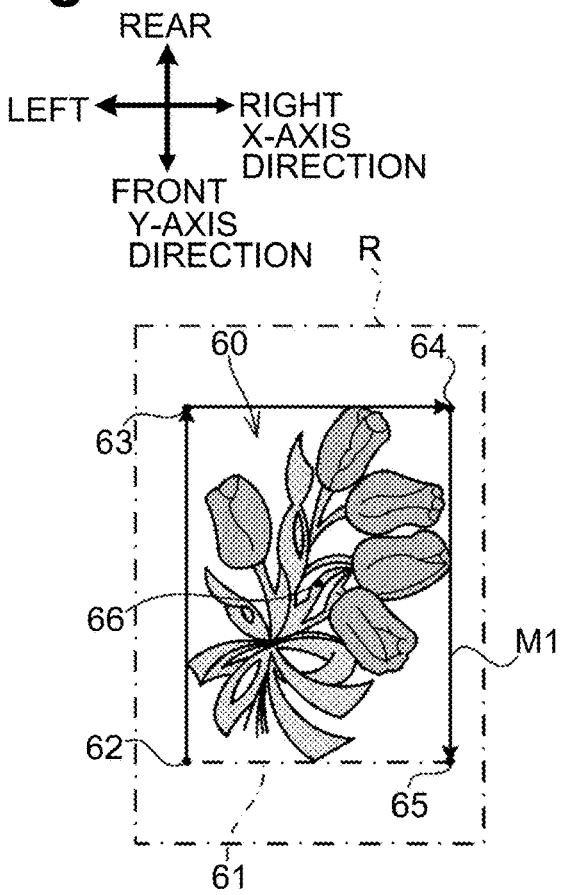
FIGS. 10A and 10B illustrate a process for determining a movement path for the embroidery hoop to be performed in the main process regarding example 1 according to one or more aspects of the disclosure.
Figure 10B:
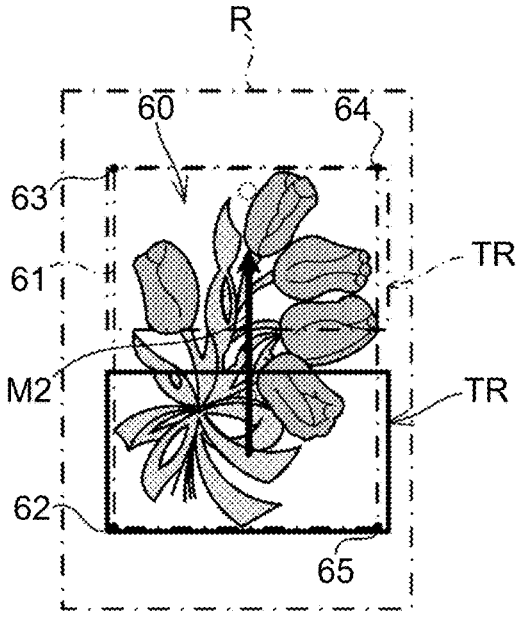

In the main process illustrated in FIG. 4, for example 1 illustrated in FIG. 5A, if the controller 2 detects that the virtual key 73 has been selected (S5: NO, S12: YES), the controller 2 determines four positions in the sewing area R corresponding to four corners of the smallest rectangle 61 enclosing the embroidery pattern 60 located in the sewing area R (S13). The controller 2 determines, for example, coordinates of the four points 62, 63, 64, and 65 in the embroidery coordinate system. The controller 2 sets a movement path to allow the movement mechanism 40 to move the embroidery hoop 50 such that the four positions (corners) in the sewing area R determined at S13 sequentially meet and coincide with the position of the needle bar 6, more specifically, coordinates of each of the four positions (corners) in the sewing area R sequentially coincide with coordinates of the needle bar 6 (S14). The controller 2 sets the shortest path sequentially connecting the four positions (corners) determined at S13 as the movement path. More specifically, as illustrated in FIG. 10A, the controller 2 sets a movement path M1, which traces, clockwise, sides of the smallest rectangle 61 of the embroidery pattern 60, starting at point 62, via points 63, 64, and ending at point 65. The controller 2 controls the movement mechanism 40 to move the embroidery hoop 50 along the movement path M1 set at S14 (S15). The controller 2 starts a process in which the controller 2 controls the movement mechanism 40 to move the embroidery hoop 50 at a specified speed such that the points on the movement path M1 set at S14 sequentially meet and coincide with the position of the needle bar 6. The process for moving the embroidery hoop 50 along the movement path M1 is continued until the end point 65 on the movement path M1 meets and coincides with the position of the needle bar 6.

Based on control signals from the drive circuits 94, 95, the controller 2 determines the current position of the embroidery hoop 50 (S16). The controller 2 determines a projection area RC where a projection image in the sewing area R corresponding to the current position of the embroidery hoop 50 is projected, as the target area TR (S17). The controller 2 may determine the target area TR considering that the embroidery hoop 50 may be moved during generation of a projection image. The controller 2 generates projection image data representing a part, which falls in the target area TR determined at S17, of the embroidery pattern 60 (S18), and controls the projector 58 to project a projection image based on the projection image data generated at S18 (S19). The controller 2 determines whether the position determined at S16 corresponds to a position where the end point on the movement path M1 meets and coincides with the position of the needle bar 6 (S20). If the controller 2 determines it is not the end point (S20: NO), the controller returns to S16. If the controller 2 determines it is the end point (S20: YES), the controller 2 stops a process for moving the embroidery hoop 50 (S21). Through steps S15 to S21, the sewing machine 1 can move the embroidery hoop 50 at a specified speed and project a projection image corresponding to the position of the embroidery pattern relative to the sewing area R.

In example 1 illustrated in FIG. 5A, if the controller 2 detects that the virtual key 74 of the screen 70 has been selected (S5: NO, S12: NO, S22: YES), the controller 2 sets a movement path to allow the movement mechanism 40 to move the embroidery hoop 50 relative to the needle bar 6 such that, while the movement mechanism 40 moves the embroidery hoop 50 relative to the needle bar 6, the projector 58 sequentially projects multiple projection images in the projection area RC, each of the multiple projection images representing a respective part of the embroidery pattern relative to the sewing area R, so that every part of the embroidery pattern is projected in the sewing area R at least once (S23, S24). More specifically, the controller 2 determines the smallest rectangle 61 enclosing the embroidery pattern 60 (S23), and sets the shortest movement path M2 to move the embroidery hoop 50 such that every part of the embroidery pattern 60 sequentially falls in the target area TR. The smallest rectangle 61 is smaller than or equal to the target area TR in the X-axis direction. In an example illustrated in FIG. 10B, the center of the smallest rectangle 61 in the X-axis direction coincides with the center of the target area TR in the X-axis direction. In this example, the controller 2 sets a movement path M2 in a manner that the target area TR moves, along the movement path M2, from a position where a segment of the smallest rectangle 61 connecting points 62, 65 is located in a front end portion of the target area TR indicated with a solid line to a position where a segment connecting points 63, 64 is located in a rear end portion of the target area TR.

The controller 2 controls the movement mechanism 40 to move the embroidery hoop 50 along the movement path M2 set at S24 (S15). The controller 2 determines the current position of the embroidery hoop 50 (S16) and the target area TR corresponding to the determined current position (S17). The controller 2 generates projection image data representing a part, which falls in the target area TR determined at S17, of the embroidery pattern 60 (S18), and controls the projector 58 to project a projection image based on the projection image data generated at S18 (S19). If the controller 2 determines the current position determined at S16 is not the end point (S20: NO), the controller returns to S16. If the controller 2 determines the current position is the end point (S20: YES), the controller 2 stops a process for moving the embroidery hoop 50 (S21).

Figure 10C:
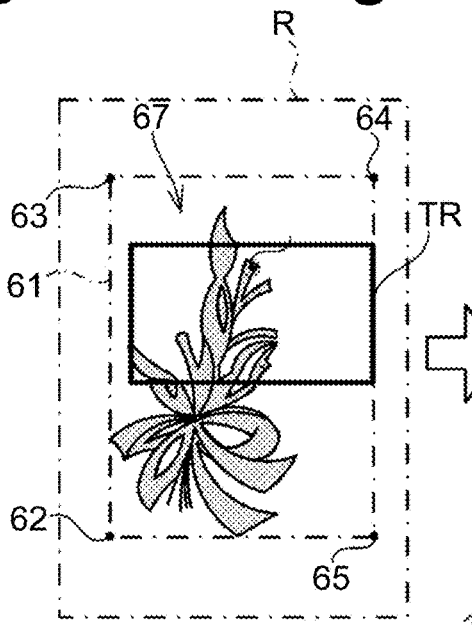
FIGS. 10C and 10D illustrate a process for projecting a projection image to be formed with a number of stitches to be performed in the main process regarding example 1 according to one or more aspects of the disclosure.
Figure 10D:
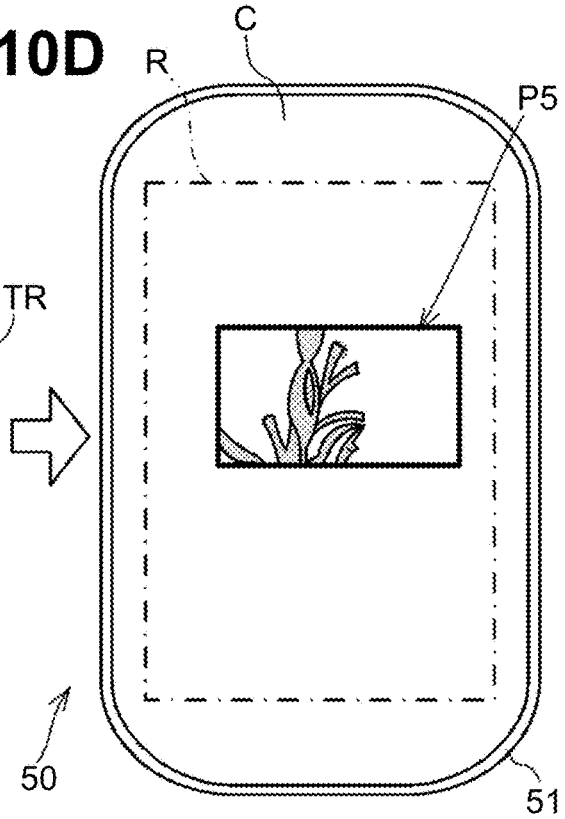

In example 1 illustrated in FIG. 5A, if the controller 2 detects that the virtual key 75 of the screen 70 has been selected (S5: NO, S12: NO, S22: NO, S25: YES), the controller 2 receives an instruction to specify the number of stitches from the start of sewing to sew the embroidery pattern (S26). The number of stitches is specified with a numeric value, for example. The controller 2 determines needle drop positions on the sewing area R for the number of stitches obtained at S26 (S27) based on the coordinate data of the pattern data for sewing the embroidery pattern 60. The controller 2 determines, for example, a position of point Q in FIG. 10C, as one of the needle drop positions corresponding to the number of stitches obtained at S26. As illustrated in FIG. 10C, the controller 2 determines the target area TR such that the needle drop positions determined at S27 sequentially meet and coincide with the position of the needle bar 6 (S28). The controller 2 determines a part of the pattern representing the number of stitches obtained at S26 to be formed (S29). The controller 2 determines, for example, a partial pattern 67 in FIG. 10C, as a part of the pattern representing the number of stitches obtained at S26 to be formed. The partial pattern 67 is a part of the embroidery pattern 60. The controller 2 controls the movement mechanism 40 to move the embroidery hoop 50 such that the needle drop positions determined at S27 sequentially meet and coincide with the position of the needle bar 6 (S30). The controller 2 generates projection image data representing the partial pattern 67 determined at S29, which falls in the target area TR, of the embroidery pattern 60 located relative to the sewing area R (S31), and controls the LCP 59 to cause the projector 58 to project a projection image based on the projection image data (S32). For example, the projector 58 projects a projection image P5 illustrated in FIG. 10D.

If the controller 2 does not detect that the virtual key 75 has been selected (S25: NO), the controller 2 determines whether it has received an instruction to start sewing, subsequent to S21 or S32 (S56). If the controller 2 detects that the virtual key 76 on the screen 70 has been selected or the start/stop switch 29 has been inputted, the controller 2 determines that it has received an instruction to start sewing. If the controller 2 does not receive the instruction to start sewing (S56: NO), the controller 2 returns to S5. If the controller 2 receives the instruction to start sewing (S56: YES), the controller 2 controls the movement mechanism 40 based on pattern data for sewing every part of the embroidery pattern as displayed in the pattern display section 71, and controls the sewing unit 30 to sew the embroidery pattern on the workpiece C held by the embroidery pattern 50 (S57). The controller 2 thus ends the main process.

The sewing machine 1 according to the above embodiment moves the hoop 50 to a position corresponding to the target area TR to project an projection image representing a part or a whole, which falls in the target area TR, of an embroidery pattern. Even when the sewing area R, which is set inside the embroidery hoop 50, is greater than the projection area RC of the projector 58, the sewing machine 1 can project an image representing a position of an embroidery pattern relative to the sewing area R properly.

The embroidery pattern 60 is greater than the projection area RC. To project a sewing image of the embroidery pattern 60, the controller 2 generates a projection image representing a part, which falls in the target area TR, of the embroidery pattern 60 (e.g., at S10). Even in a case where an embroidery pattern in the sewing area R is greater than the projection area RC, the sewing machine 1 according to the above embodiment moves the hoop 50 to a position corresponding to the target area TR to project an projection image representing a part, which falls in the target area TR, of the embroidery pattern (e.g., at S11).

The controller 2 receives an instruction to designate the position of the target area TR in the sewing area R (S35). The controller 2 determines the target area TR based on the received instruction (S37). The sewing machine 1 can project a projection image representing a part of an embroidery pattern in the target area TR designated by the user (S37), in accordance with the position of the embroidery pattern relative to the sewing area R (S41).

The sewing machine 1 includes the LCD 15 to display an image. The controller 2 allows the LCD 15 to display a marker Z representing the position of the target area TR relative to the sewing area R, overlaid on an embroidery pattern located relative to the sewing area R (S9). The controller 2 receives an instruction to change the relative position between the marker Z and the embroider pattern, as an instruction to designate the position of the target area TR (S35). The user can easily check the correspondence between the position of the target area TR relative to the sewing area R and the projection image to be projected by the projector 58 on the LCD 15. The sewing machine 1 enables the LCD 15 to display a projection image representing an embroidery pattern to be sewn. If the projection image represents only a part of the embroidery pattern, the LCD 15 displays which part of the embroidery pattern is to be sewn.

The controller 2 receives a change instruction to change the position of the marker Z relative to the embroidery pattern, which is fixedly displayed on the LCD 15 (S35). The controller 2 receives a change instruction to change the position of an embroidery pattern relative to the marker Z, which is fixedly displayed on the LCD 15 (S35). Whichever change instruction the user sets, the sewing machine 1 allows the user to see the LCD 15 and input a change instruction to change the relative position between the marker Z and the embroidery pattern, which are displayed on the LCD 15.

If the embroidery pattern is smaller than the projection area RC (S8: YES), the controller 2 does not display the marker Z on the LCD 15 and determines the target area TR such that the whole of the embroidery pattern is fit in the target area TR (S63). The sewing machine 1 can thus switch between displaying and not displaying the marker Z on the LCD 15 comparing the sizes of the embroidery pattern and the projection area RC. If the embroidery pattern is smaller in size than the projection area RC, the sewing machine 1 projects a projection image representing a whole of the embroidery pattern in the projection area RC.

If the controller 2 determines that the target area TR is not fit in the sewing area R based on the instruction received at 35 (S36: NO), the controller 2 repeats steps S 35 and S 36 until the target area TR is fit in the sewing area R, and then sets the target area TR in the sewing area R (S37). The sewing machine 1 reliably sets the target area TR within the sewing area R.

The controller 2 receives an instruction to specify the background color of the projection image (S49). The controller 2 sets the background color based on the received instruction, and generates a projection image representing the embroidery pattern in the target area TR (S50). The sewing machine 1 enables background color changing for a projection image based on the instruction. The user can specify a background color appropriate to a color or material of the workpiece C held by the embroidery hoop 50 for easy identification.

The controller 2 determines the four positions in the sewing area R corresponding to the four corners of the smallest rectangle enclosing the embroidery pattern (13). The controller 2 sets a movement path M1 to allow the movement mechanism 40 to move the embroidery hoop 50 such that the four positions (corners) in the sewing area R determined at S13 sequentially meet and coincide with the position of the needle bar 6 (S14). The controller 2 moves the embroidery hoop 50 along the set movement path M1 (S15). The controller 2 determines the current position of the embroidery hoop 50 (S16) and the target area TR corresponding to the determined current position (S17). To move the embroidery hoop 50 such that the four positions (corners) of the smallest rectangle of the embroidery pattern sequentially meet and coincide with the position of the needle bar 6, the sewing machine 1 enables displaying a projection image representing a part of the embroidery pattern, which corresponds to a current position of the embroidery hoop 50. Through the projection image, the user can confirm how much the embroidery pattern occupies the sewing area R and how the embroidery pattern is positioned relative to the sewing area R.

The controller 2 sets a movement path M2 to allow the movement mechanism 40 to move the embroidery hoop 50 relative to the needle bar 6 such that, while the movement mechanism 40 moves the embroidery hoop 50 relative to the needle bar 6, the projector 58 sequentially projects multiple projection images in the projection area RC, each of the projection images representing a respective part of the embroidery pattern relative to the sewing area R, so that every part of the embroidery pattern is projected in the sewing area R at least once (S24). The controller 2 moves the embroidery hoop 50 along the set movement path M2 set at S24. The controller 2 determines the current position of the embroidery hoop 50 (S16) and the target area TR corresponding to the determined current position (S17). The sewing machine 1 enables the projector 58 to project a subsequence of projection images, each representing a part of the entire embroidery pattern relative to the sewing area R, at respective positions corresponding to the needle bar 6, while moving the embroidery hoop 50 relative to the needle bar 6. Even when the embroidery pattern is greater than the projection area RC, an image representing every partial pattern of the embroidery pattern is sequentially projected onto an actual workpiece C. This enables the user to visually check the position of the embroidery pattern and the finished image.

The controller 2 receives an instruction to obtain the number of stitches from the start of sewing to sew the embroidery pattern (S26). The controller 2 determines needle drop positions on the sewing area R for the determined number of stitches (S27). The controller 2 determines a part of the pattern representing the determined number of stitches to be formed (S29). The controller 2 determines the target area TR such that the needle drop positions determined at S27 sequentially meet and coincide with the position of the needle bar 6 (S28). The controller 2 controls the movement mechanism 40 to move the embroidery hoop 50 such that the determined needle drop positions sequentially meet and coincide with the position of the needle bar 6 (S30). The controller 2 generates a projection image representing the part determined at S29, which falls in the target area TR, of the embroidery pattern located relative to the sewing area R (S31). The sewing machine 1 can project the projection image representing a partial pattern to be formed with the determined number of stitches, of the embroidery pattern located relative to the sewing area R. Through the projection image, the user can visually confirm the position of the partial pattern, which is to be formed with the determined number of stitches, of the entire embroidery pattern in the sewing area R.

While aspects are described in detail with reference to the specific embodiment thereof, this is merely an example, and various changes, arrangements and modifications may be made therein without departing from the spirit and scope of the disclosure. For example, the following modifications (A) to (C) may be made to the above embodiment.

(A) Configuration of the sewing machine 1 with an attachable embroidery hoop may be modified as desired. Examples of the sewing machine 1 includes an industrial sewing machine or a multi-needle sewing machine. The movement mechanism 40 moves the holder 43 relative to the needle bar 6 at least in a first direction and a second direction orthogonal to the first direction. The movement mechanism 40 may be fixed to the sewing machine 1. The embroidery hoop 50 may have any size within a certain range and any shape such as a circle and a oval. In addition to the touch screen 26, examples of an input device may include a keyboard, a mouse, and a joystick. As long as a display is configured to display an image, other display than the LCD 15 may be used. Examples of a display may include an organic EL display, a plasma display, a plasma tube array display, and an electronic paper display that uses electrophoresis. The projector may be relocated to change a position of the projection area. Colors that the projector can display may be changed. The disclosure may be applicable by various forms, for example, non-transitory computer-readable media storing sewing machine programs and different projection methods.

(B) A program including instructions that causes the controller 2 to perform the main process of FIG. 4 may be stored in a storage device of the sewing machine 1 before the sewing machine 1 executes the program. Thus, a method for obtaining the program, a route through which the program is obtained, and a device that stores the program may be changed as desired. The program that is executed by the controller 2 may be received from another device via a cable or wireless communication, and may be stored in a storage device such as a flash memory. Examples of the other device include a PC and a server connected via a network.

(C) The steps in the main process of the sewing machine 1 are not limited to being executed by the controller 2, but some or all of the steps may be executed by another electronic device (e.g., an ASIC). In some embodiments, the steps of the main process may be executed by multiple electronic devices (e.g., CPUs). The steps of the main process may be executed in a different order. A step may be omitted from or added to the main process. The scope of the disclosure includes such configuration that an operating system (OS) operating on the sewing machine 1 executes some or all of the steps of the main process based on a command/instruction from the controller 2. For example, the following modifications (C-1) to (C-3) may be added to the main process.

(C-1) The embroidery pattern may be smaller than the projection area. The embroidery pattern may be greater than the sewing area. The methods to receive an instruction to specify the position of the target area in the sewing area may be changed according to configuration of the input device of the sewing machine 1. Layout of a screen and icons of virtual keys to be displayed in a display may be changed as desired. The sewing machine 1 may execute a part or all of processes of which the controller detects that each of the virtual keys 72-75, 79 and each key on the virtual keypads 77, 78 has been selected. The controller 2 may execute the same processing regardless of whether the embroidery pattern is fit in the target area. The background color to be specified at S49 may be changed as appropriate. Steps S36 and S43 may be omitted as appropriate. Instead, the controller 2 may allow the target area or embroidery pattern to be moved to a position outside the sewing area.

(C-2) Displaying a marker representing the position of the target area may be changed as appropriate. The marker may be displayed by changing its color, line type, or line thickness as appropriate. For example, the controller 2 may increase the brightness of a portion of the embroidery pattern located in the target area more than that of another portion of the embroidery pattern located outside the target area, to display the embroidery pattern with distinctly different tones between in and outside the target area.

(C-3) The movement path set at S14 or S24 may not be the shortest. For example, the controller 2 may set the movement path at S14 or S24 such that every portion of the entire sewing area R sequentially falls in the projection area. When the sewing area R is included in the projection area RC in the X-axis direction, the controller 2 may project a projection image corresponding to an area, which is fit in the sewing area R only included in the projection area RC at S19.

What is claimed is:

1. A sewing machine, comprising:

a bed;

a movement mechanism configured to support an embroidery hoop removably and move the embroidery hoop;

a sewing unit including a needle bar, the needle bar supporting a needle, the sewing unit being configured to move the needle bar up and down relative to a workpiece held by the embroidery hoop attached to the movement mechanism such that the needle supported in the needle bar forms stitches on the workpiece;

a projector configured to project a projection image toward the bed; and a controller configured to control the movement mechanism, the sewing unit, and the projector, the controller being further configured to:

control the projector to project a projection image representing a part of an embroidery pattern, the embroidery pattern being greater than a projection area in which the projector projects the projection image.

2. The sewing machine according to claim 1, wherein the controller is further configured to:

determine a target area in response to a position of the embroidery hoop, the target area corresponding to the projection area set inside a sewing area set inside the embroidery hoop; and control the projector to project the projection image representing the part, which falls in the determined target area, of the embroidery pattern located relative to the sewing area.

3. The sewing machine according to claim 2, wherein the controller is configured to:

set a movement path to move the embroidery hoop;

control the movement mechanism to move the embroidery hoop along the movement path;

determine a current position of the embroidery hoop when the movement mechanism is controlled; and control the projector to project the projection image representing the part of the embroidery pattern based on the current position of the embroidery hoop.

4. The sewing machine according to claim 3, wherein the controller is configured to:

determine a smallest rectangle enclosing the embroidery pattern; and set the movement path based on the smallest rectangle.

5. The sewing machine according to claim 4, wherein the controller is configured to:

determine four positions in the sewing area corresponding to four corners of the smallest rectangle; and set the movement path based on a shortest path sequentially connecting the four positions.

6. The sewing machine according to claim 5, wherein the controller is configured to set the movement path based on the shortest path to allow the movement mechanism to move the embroidery hoop such that the four positions in the sewing area sequentially meet and coincide with a position of the needle bar.

7. The sewing machine according to claim 3, wherein the controller is configured to set the movement path based on a path to allow the movement mechanism to move the embroidery hoop relative to the needle bar such that, while the movement mechanism moves the embroidery hoop relative to the needle bar, the projector sequentially projects multiple projection images in the projection area, each of the projection images representing a respective part of the embroidery pattern relative to the sewing area, so that every part of the embroidery pattern is projected in the sewing area at least once.

8. The sewing machine according to claim 3, wherein the controller is configured to set the movement path such that every part of the embroidery pattern sequentially falls in the target area.

* * * * *